US005460115A

United States Patent [19]

Speer et al.

[11] Patent Number: 5,460,115

[45] Date of Patent: Oct. 24, 1995

[54] TEMPORARY ROADWAY MARKER

[75] Inventors: Peter A. Speer, Kirkland; Harry J. Glutting, Jr., Tacoma, both of Wash.

[73] Assignee: Davidson Plastics Corporation, Kent, Wash.

[21] Appl. No.: 193,774

[22] Filed: Feb. 10, 1994

Related U.S. Application Data

[63] Continuation of Ser. No. 916,585, Jul. 20, 1992, abandoned, which is a continuation-in-part of Ser. No. 735,321, Jul. 24, 1991, Pat. No. 5,327,850, which is a continuation-in-part of Ser. No. 694,873, May 2, 1991, abandoned.

[51] Int. Cl.[6] ..... E01F 9/047; E01F 9/017; E01F 9/015

[52] U.S. Cl. ..... 116/63 P; 116/63 R; 404/10; 404/16

[58] Field of Search ..... 116/63 R, 63 P; 404/10, 15, 16

[56] References Cited

U.S. PATENT DOCUMENTS

| | | | |
|---|---|---|---|
| D. 289,267 | 4/1987 | Garner | D10/113 |
| 1,798,468 | 3/1931 | Hartzler et al. | 404/15 X |
| 1,830,319 | 11/1931 | Hartzler et al. | 404/10 |
| 2,208,080 | 7/1940 | Overdorff | 404/15 X |
| 2,666,373 | 1/1954 | Mattson | 404/16 |
| 2,991,698 | 7/1961 | Leubaz | 404/16 |
| 3,179,009 | 4/1965 | Sheffield et al. | 88/79 |
| 3,485,148 | 12/1969 | Heenan | 404/12 |
| 3,785,719 | 1/1974 | Jonnes | 350/105 |
| 4,061,435 | 12/1977 | Schmanski et al. | 404/10 |
| 4,089,533 | 5/1978 | Knudson | 277/165 X |
| 4,119,325 | 10/1978 | Oakley et al. | 277/207 R |
| 4,375,290 | 3/1983 | Zucchi et al. | 277/228 X |
| 4,429,886 | 2/1984 | Buttner | 277/228 X |
| 4,445,803 | 5/1984 | Dixon | 404/10 |
| 4,462,711 | 7/1984 | Garner | 404/10 |
| 4,521,129 | 6/1985 | Krech et al. | 404/10 |
| 4,534,673 | 8/1985 | May | 404/14 |
| 4,542,709 | 9/1985 | Spaugh | 116/63 P |
| 4,552,089 | 11/1985 | Mahoney | 116/63 P |
| 4,626,127 | 12/1986 | May | 404/14 |
| 4,659,248 | 4/1987 | Flanagan | 404/10 |
| 4,991,994 | 2/1991 | Edouart | 404/10 |

FOREIGN PATENT DOCUMENTS 2175335 5/1985 United Kingdom .

*Primary Examiner*—William A. Cuchlinski, Jr.
*Assistant Examiner*—John L. Beres
*Attorney, Agent, or Firm*—Christensen, O'Connor, Johnson & Kindness

[57] ABSTRACT

A temporary roadway marker having an L-shape that includes a base adapted to be attached to the roadway surface and an upwardly extending leg on which a reflective strip may be mounted is disclosed. The body of the roadway marker is formed of two materials having different flexural moduli, thus allowing the upper portion of the roadway marker to be formed of a material having a flexural modulus similar to that of the reflective strip. This helps to prevent stress concentration in the interface in between the reflective strip and the upper portion of the roadway marker, thus reducing cracks and failure of the reflective strip. In addition, it allows the base and the transition between the base and the upwardly extending leg to be formed of a more flexible material, which allows better flexing without breakage and the base to conform to the roadway surface. The roadway marker may also include a reverse curve, or nubbles located on opposite sides of the interface, between the upwardly extending leg and the base of the roadway marker to decrease stress concentrations when the leg deforms upon contacting a vehicle's tire.

32 Claims, 3 Drawing Sheets

TEMPORARY ROADWAY MARKER

CROSS-REFERENCE TO RELATED APPLICATION

This application is a continuation application based on prior copending application Ser. No. 07/916,585, filed on Jul. 20, 1992, now abandoned which is a continuation-in-part of U.S. patent application Ser. No. 07/735,321, filed Jul. 24, 1991, now U.S. Pat. No. 5,327,850 which is a continuation-in-part of U.S. patent application Ser. No. 07/694,873, filed May 2, 1991, now abandoned both entitled Roadway Marker.

FIELD OF THE INVENTION

This invention relates to roadway markers and, more particularly, to an extrudable temporary roadway marker having improved performance.

BACKGROUND OF THE INVENTION

Roadway markers are utilized in a variety of traffic control applications. Many roadway markers are permanently affixed to a roadway to delineate lanes of traffic on a roadway. Other roadway markers are used to temporarily delineate lanes of traffic at construction or other work areas. Roadway markers used in such applications are called temporary roadway markers. Temporary roadway markers are usually attached to the surface of the roadway with a suitable adhesive that holds the marker in place during the temporary life of the roadway marker.

Temporary roadway markers serve to identify the edge of the road and lane lines, and notify motorists that caution is needed because a construction area is near. Temporary roadway markers often direct roadway traffic to pass along the portions of the roadway unaffected by the construction, while protecting workers within a construction area from roadway traffic. After the construction is complete, the temporary roadway markers are loosened and removed.

To be effective, temporary roadway markers must clearly alert oncoming traffic of the construction area. Typically, temporary roadway markers warn oncoming motorists by (1) the use of visual cues, such as brightly colored or reflective surfaces, or (2) the use of physical cues, such as causing a vehicle to rumble on contact with a roadway marker.

One example of a temporary roadway marker is described in U.S. Pat. No. 4,991,994, issued to Edouart. The Edouart patent describes a temporary roadway marker having a generally L-shaped configuration. One of the legs ("the base") of the L is designed to be attached to the roadway surface while the other leg extends upwardly from the roadway surface. The upstanding leg of the roadway marker has a reflective strip attached along its top edge. As with other prior temporary roadway markers, the reflective strip reflects the sun or a vehicle's headlights and improves the visual cue provided by the roadway marker. The upstanding leg raises the reflective strip above the surface of the road, thus helping to keep the reflective strip out of rubble, dust, or other materials present at construction sites. Keeping the reflective strip free of debris improves the ability of the temporary roadway marker to warn the motorist.

One of the notable failures of temporary roadway markers as described above is that they have a very short lifetime. When temporary roadway markers are used to mark the lane lines on a roadway construction project, they are often impacted by a vehicle's tire. This bends the upstanding leg of the roadway marker downwardly into contact with the road. If the roadway marker is not formed of a very flexible, resilient material, the bending can cause a permanent set and/or failure of the roadway marker in a very short number of cycles.

Prior art temporary roadway markers as described above are currently made of a single-hardness, flexible thermoplastic material, such as polyurethane. The flexibility of the polyurethane allows the leg of the roadway marker to bend over without breaking or cracking. A reflective strip is generally adhesively bonded to the top portion of the roadway marker. Although many different retro-reflective materials are available, very few have proven suitable for use on flexible roadway markers. Reflective strips made of materials such as flexible polyvinyl chloride, acrylic or polyester either provide insufficient reflectivity, are quick to delaminate upon impact with a vehicle tire, or otherwise degrade and are unsuitable for this use.

A proven retro-reflective material that provides sufficient retro-reflectivity and durability is polycarbonate. Polycarbonate reflective strips are made from thin sheet embossed with a cube-corner microprism pattern and then metalized to provide retro-reflectivity. Polycarbonate materials provide excellent optical performance and durability. Other high performance retro-reflective materials having similar optical performance and durability could also be used. The polycarbonates used to form the reflective strips have higher flexural modulis than the materials used to form the roadway marker.

Because the flexural modulus of the polycarbonate reflective strips and the body of the roadway marker differ, often by a factor of two or three, structural problems are produced when the upstanding leg of the roadway marker is bent or deformed. More specifically, as a vehicle contacts the roadway marker, the flexible body of the roadway marker flexes to a greater extent and at a greater rate than the stiffer reflective strip. The difference in the deformation of the reflective strip and body of the roadway marker creates stress concentrations at the interface between the reflective strip and body of the roadway marker. The stress concentrations cause the harder reflective strip to crack and eventually break up and become detached from the body of the roadway marker, reducing the visual cue provided by the roadway marker, particularly at night.

Some prior art roadway markers have attempted to remedy these problems by making the body of the roadway marker stiffer such that its flexural modulus is closer to that of the reflective strip. However, this decreases the life of the body of the roadway marker because stiffer materials are more susceptible to cracking and breaking during bending. Other prior art markers have attempted to remedy the problems by using a very flexible reflective material, such as 3M Engineer Grade sheeting. While not degrading quickly, the Engineer Grade sheeting has reflectivity of less than 10% that of polycarbonate, resulting in an unacceptably poor level of visibility at night.

Depending upon traffic volume, if the construction project on which the temporary roadway markers are used continues for more than a couple of weeks, the temporary roadway markers must be replaced, increasing expense. More specifically, the lifetime of a temporary roadway marker is directly related to how many impacts the roadway marker receives. The number of impacts is, of course, related to traffic volume. Under typical traffic conditions, temporary roadway markers last for approximately two weeks before they must be replaced.

In addition to the failure of temporary roadway markers due to loss of the reflective strip, temporary roadway markers are also prone to failure at the interface between the upstanding leg of the roadway marker and the base of the roadway marker. These failures result from the lack of elasticity in the sharp bend located at the interface. More specifically, most prior art temporary roadway markers consist of an L-shaped extrusion. The L-shaped extrusion includes curved fillet located where the base leg and the upstanding leg of the roadway marker are joined. The fillet increases the amount of material at the interface between the base and leg of the roadway marker. The additional material increases the stiffness of the roadway marker at the interface. The increased stiffness, in turn, produces local stress concentrations at the interface between the base and leg when the leg is bent due to contact with a vehicle's tire. The local stress concentrations lead to failure of the roadway marker after an undesirably small number of cycles.

In addition to the stress concentrations caused by the increased material at the interface, some prior art roadway markers allow the upstanding leg to be bent such that a very small radius of curvature is produced at the interface between the leg and the base of the roadway marker. The tight radius of curvature produces very large stress concentrations which further contribute to failure of the roadway marker.

The present invention is directed to providing a temporary roadway marker that overcomes the foregoing disadvantages of prior and temporary roadway markers.

SUMMARY OF THE INVENTION

In accordance with this invention, a lightweight, low-cost roadway marker that provides an oncoming motorist with a clear visual cue and a rumble to alert the motorist of a construction area is provided. As with prior art temporary roadway markers, roadway markers formed in accordance with this invention are generally L-shaped and include a base adapted to be attached to the surface of the roadway. A leg that extends upwardly from the base provides a visual cue to alert oncoming motorists. A reflective strip located near the top of the leg adds to the visual cue. Roadway markers formed in accordance with this invention include at least two different materials having different flexural moduli. The base and transition region between the leg and base are formed from a material having a flexural modulus that allows the leg to deform downwardly toward the surface of the roadway when it is contacted by a vehicle's tire. The upper portion of the leg is formed from a material having a higher flexural modulus, i.e., a stiffer material. Preferably, the flexural modulus of the upper portion of the leg is similar to the flexural modulus of the reflective strip. This similarity reduces the stress concentrations at the interface between the leg and the reflective strip, thus reducing the failure rate and increasing the life of the roadway marker.

According to other aspects of the present invention, the transition region has a reverse curve that extends approximately parallel to the base of the roadway marker and then curves upwardly from the leg. This embodiment of the present invention is placed on the surface of the roadway such that the reverse curve transition region extends in the direction of an oncoming vehicle. The reverse curve eliminates the small radius of curvature included in prior art roadway markers, thus reducing stress concentrations and increasing the life of the roadway marker. Stress concentrations are reduced because the reverse curve results in the transition region of the roadway marker being flattened as the roadway marker is contacted by a vehicle's tire.

According to alternate aspects of the present invention, the roadway marker includes nubbles that extend outwardly from the transition region in between the base and leg of the roadway marker. The nubbles increase the radius of curvature in the transition region when the leg is bent toward the roadway surface upon being contacted by a vehicle's tire. This, in turn, lowers the stress concentrations in the transition region, thus decreasing the failure rate and increasing the life of the roadway marker.

According to still other aspects of the invention, the lower surface of the base, which attaches the roadway marker to the roadway surface, includes a series of grooved teeth extending downwardly from the base. The grooved teeth are curved outwardly from a centerline over their length to increase the surface area and enhance the adhesive grip to the roadway surface.

BRIEF DESCRIPTION OF THE DRAWINGS

The foregoing aspects and the attendant advantages of the present invention will be more readily appreciated and better understood by reference to the following detailed description and the accompanying drawings, wherein.

DETAILED DESCRIPTION OF THE PREFERRED EMBODIMENTS

Figure 1:
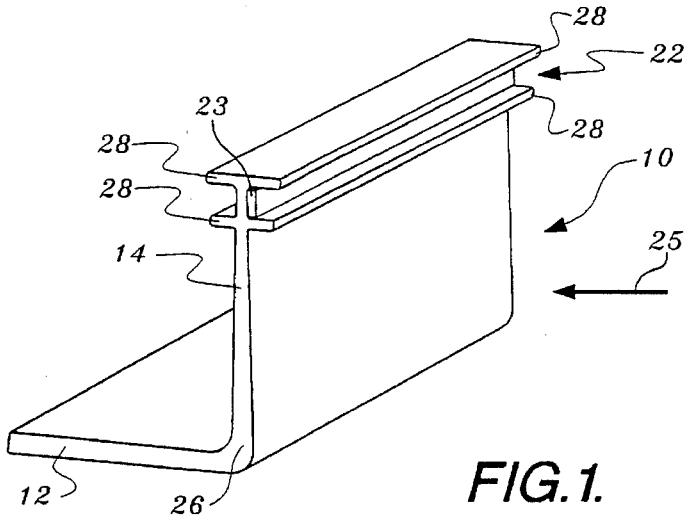
FIG. 1 is a perspective view of a first embodiment of a temporary roadway marker formed in accordance with the present invention.

As shown in FIG. 1, a roadway marker 10 formed in accordance with this invention is an integral piece having a constant cross section. The constant cross section allows the marker to be extruded and then sheared to any desired length. The roadway marker 10 is generally L-shaped having a base 12 for attachment to the roadway surface and an upwardly extending leg 14 that provides a visual cue to an oncoming motorist.

The base 12 is substantially planar, of a rectangular shape and extends horizontally along the surface of the roadway. The base 12 is used to attach the roadway marker to a roadway surface through the use of a suitable adhesive, such as epoxy, synthetic butyl, rubber or hot melt bituminous adhesives. The adhesive is applied to the surface of the roadway or the bottom of the base. The roadway marker is then placed in the proper location, pressure is applied and the adhesive is allowed to set.

The front edge of the base 12 curves upwardly in a transition region 26 into the leg 14. The leg 14 extends along the length of the roadway marker, approximately perpendicular to the base 12. A pair of parallel ledges 28 extend approximately perpendicularly from each side of the upper portion of the leg 14. Each pair of ledges 28 extend across the width of the roadway marker and are in an opposed facing relationship that defines a channel 22.

A generally rectangular reflective strip 23 is adhesively bonded to the leg 14, at the base of the channel 22. The reflective strip extends along approximately the entire length of the roadway marker. The parallel ledges 28 confine the reflective strip 23 and help to maintain it within the channel 22. The ledges also help to protect the reflective strip from damage when the leg is bent downwardly upon contact with a vehicle's tire, as described below. The reflective strip 23 is formed of a material capable of reflecting sunlight or an oncoming vehicle's lights in order to improve the visual cue provided by the roadway marker. In the preferred embodiment, the reflective strip is formed from a polycarbonate thermoplastic; however, other materials with reflective properties could also be used.

When contacted by a wheel of a vehicle traveling in the direction shown by arrow 25, the leg 14 bends rearwardly and downwardly until it contacts the base 12. In order to prevent the leg 14 from breaking during bending, the transition 26 must be flexible enough to allow the roadway marker to bend. The more flexible, the more bends that will occur before a break occurs at the transition region. Of course, the transition region must be stiff enough to return the leg 14 to an upright position.

According to the present invention, the base 12 of the roadway marker and the transition region 26 in between the base and the leg 14 of the roadway marker are formed of a flexible material capable of conforming to the surface of the roadway and of allowing the roadway marker to flex in transition region 26 when the leg 14 is contacted by a vehicle's tire. In contrast, the upper portion of the leg 14 is formed from a more rigid material. The flexural modulus of the material used to form the upper portion of the leg is selected to approximately match the flexural modulus of the reflective strip 23.

Matching the flexural modulus of the material from which the upper portion of the leg is formed to the flexural modulus of the material from which the reflective strip is formed helps to prevent failure of the reflective strip when the roadway marker is contacted by a vehicle's tire. The reflective strip and upper portion of the leg of the present invention flex approximately to the same degree and at the same rate when contacted by a vehicle's tire. This helps to prevent high stress concentrations from being introduced in the reflective strip or the adhesive interface in between the reflective strip and the channel 22. Reducing these stress concentrations helps to prevent subsequent breakup or detachment of the reflective strip from the channel 22 thus increasing the useful lifetime of the roadway marker.

In the preferred embodiment, the more rigid portion of the leg 14 begins approximately 0.25 inches up from the base 12. However, the interface between the more rigid portion and less rigid portion could be located elsewhere, as long as the transition region 26 is flexible and the upper portion of the leg is approximately the same rigidity as the reflective strip.

The roadway marker 10 is mounted on a roadway surface such that the base lies in the direction away from oncoming traffic. Thus, the side of the leg 14 opposed to the base faces the direction of travel of the oncoming traffic as indicated by arrow 25. As the leg of the roadway marker is contacted by a vehicle's tire, the leg is bent rearwardly and downwardly toward the base and roadway surface. The lower flexural modulus in the lower portion of the leg causes bending to take place primarily in the lower portion of the leg and in the transition region 26 where the leg joins the base. Thus, in addition to reducing failure of the reflective strip 23, the present invention also helps to reduce failure of the roadway marker by reducing breakage along the transition region 26. Thus, in accordance with the invention, the lower portion of the leg and the transition region 26 can be formed of a much more flexible material capable of sustaining a greater number of bending cycles without cracking or failing while the upper portion can be formed of a stiffer material that retains the reflective strip.

Preferably, the roadway markers formed in accordance with this invention are created through the use of a dual durometer extrusion process. Dual durometer extrusion processing for forming an extrusion of materials having different moduli at different points in the extrusion is well-known in the art. In the preferred embodiment, the roadway marker is extruded using two polyurethane materials having different durometers, thus flexural moduli. Other materials can also be used. Further, in some environments, it may be advantageous to form the roadway marker with more than two sections with different flexural moduli. This could help ensure that the change in flexural modulus between the individual portions of the roadway marker do not become so severe as to cause problems at the interface.

The flexural modules of a typical polycarbonate reflector as defined by ASTM D790 is approximately 345,000 psi. The body of prior art roadway markers are generally formed from a polyurethane material having a flexural modulus of approximately 4,000–11,000 psi. The preferred embodiment uses a polyurethane material with a flexural modulus of approximately 150,000 psi to form the upper portion of the leg and 4,000–11,000 psi to form the lower base and transition region. However, other materials having other material properties could also be used.

Figure 2:
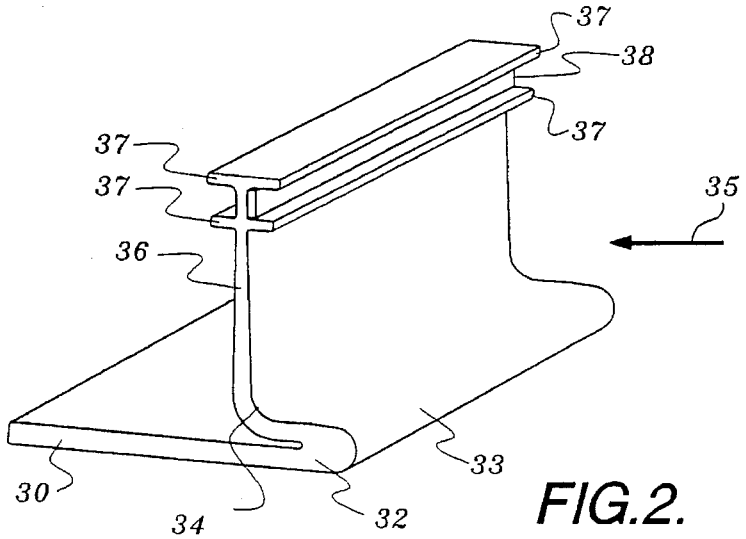
FIG. 2 is a perspective view of a second embodiment of a roadway marker formed in accordance with the present invention.

FIG. 2 shows a second embodiment of a roadway marker according to the present invention. One object of the second embodiment is to further reduce the stress concentration at the interface between the base and leg of the roadway marker when it is contacted by a vehicle's tire. This in turn further reduces the failure rate of the temporary roadway markers. The second embodiment includes a base 30 for attachment to the roadway surface and an upwardly extending leg 36. The leg 36 includes two pairs of ledges 37 and a reflective strip 38 as described with respect to the first embodiment. The difference between the second embodiment and the first embodiment is the manner in which the leg 36 is connected to the base 30.

In the second embodiment, the front of the base 30 does not simply curve upwardly to form the leg 36. Instead, the front of the base includes a reverse curve. The reverse curve begins where the base transitions into a reinforced area 32 which has a round front edge 33 and is approximately the thickness of the base and leg combined. The transition includes a curved region 34 that extends rearwardly from the back of the reinforced area 32 approximately parallel to the base and then upwardly into the leg. The second embodiment is designed to be secured on the roadway surface such that the rounded front edge of the transition region points in the direction of oncoming traffic as shown by arrow 35. This configuration allows the leg to be bent rearwardly and downwardly when it is contacted by a vehicle's tire. During contact with the vehicle's tire, the curved transition region 34 is slowly bent downwardly until it is approximately flat against the base 30. This allows the leg to be bent rearwardly and downwardly without creating the large stress concentrations present in prior art roadway markers. While embodiments of the invention illustrated in FIG. 2 can be formed of a material having a uniform flexural modulus, preferably, as described with respect to the first embodiment, the leg of the roadway marker is formed of a material having a greater flexural modulus in order to reduce the stress concentrations on the interface between the reflective strip 38 and the leg 36.

Figure 3:
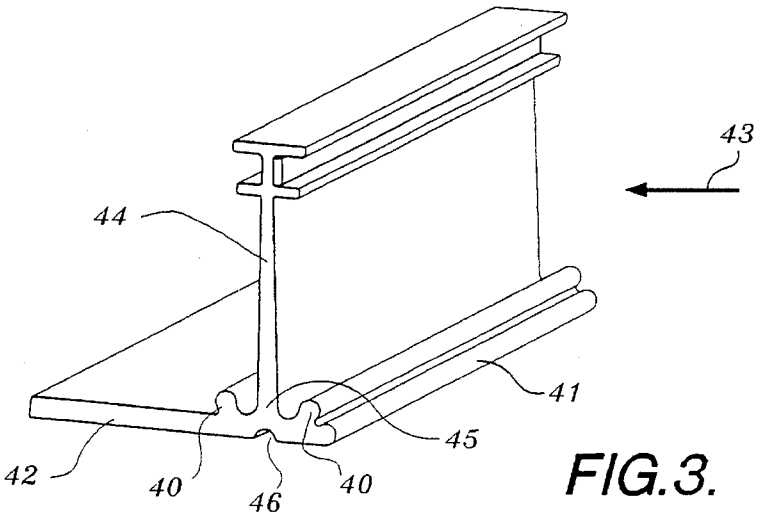
FIG. 3 is a perspective view of a third embodiment of a roadway marker formed in accordance with the present invention.

FIG. 3 shows a third embodiment of a roadway marker formed in accordance with the present invention. The third embodiment is similar to the first embodiment except for the configuration of the transition region between the base 42 and the leg 44. In the third embodiment, a nubbles is located at the interface in between the base and leg. While a single nubbles may be located on the side of the interface remote from the direction 43 of oncoming traffic, as shown in FIG. 3, the base may extend past the leg in the direction of oncoming traffic. In the case of an extension 41, a second nubbles 40 may also be located between the extension 41 and the leg 44. Preferably, the nubbles are semicircular protrusions that extend upwardly from the base adjacent the leg and run the length of the roadway marker. The semicircular protrusions are located such that as the leg is bent forward or backward, the leg contacts the protrusions. This increases the radius of curvature in the transition region 45 between the base and leg when the leg is bent forward or rearward. Increasing the radius of curvature in the transition region when the leg is bent decreases stress concentrations that occur when the leg contacts a vehicle's tires and is bent. This, in turn, increases the number of cycles which the roadway marker can withstand prior to failure.

In addition to using nubbles, it is also advantageous to place a groove 46 in the lower surface of the base underneath the intersection between the base and leg. The groove 46 helps maintain a constant cross-sectional area throughout the transition region 45. The constant cross-sectional area helps the transition region to deform uniformly, thus further reducing stress concentrations.

While the third embodiment could be extruded of a material having a uniform flexural modulus, as with the first embodiment of the invention, preferably different flexural moduli are used to reduce failures at the interface between the reflective strip and the leg.

Figure 4:
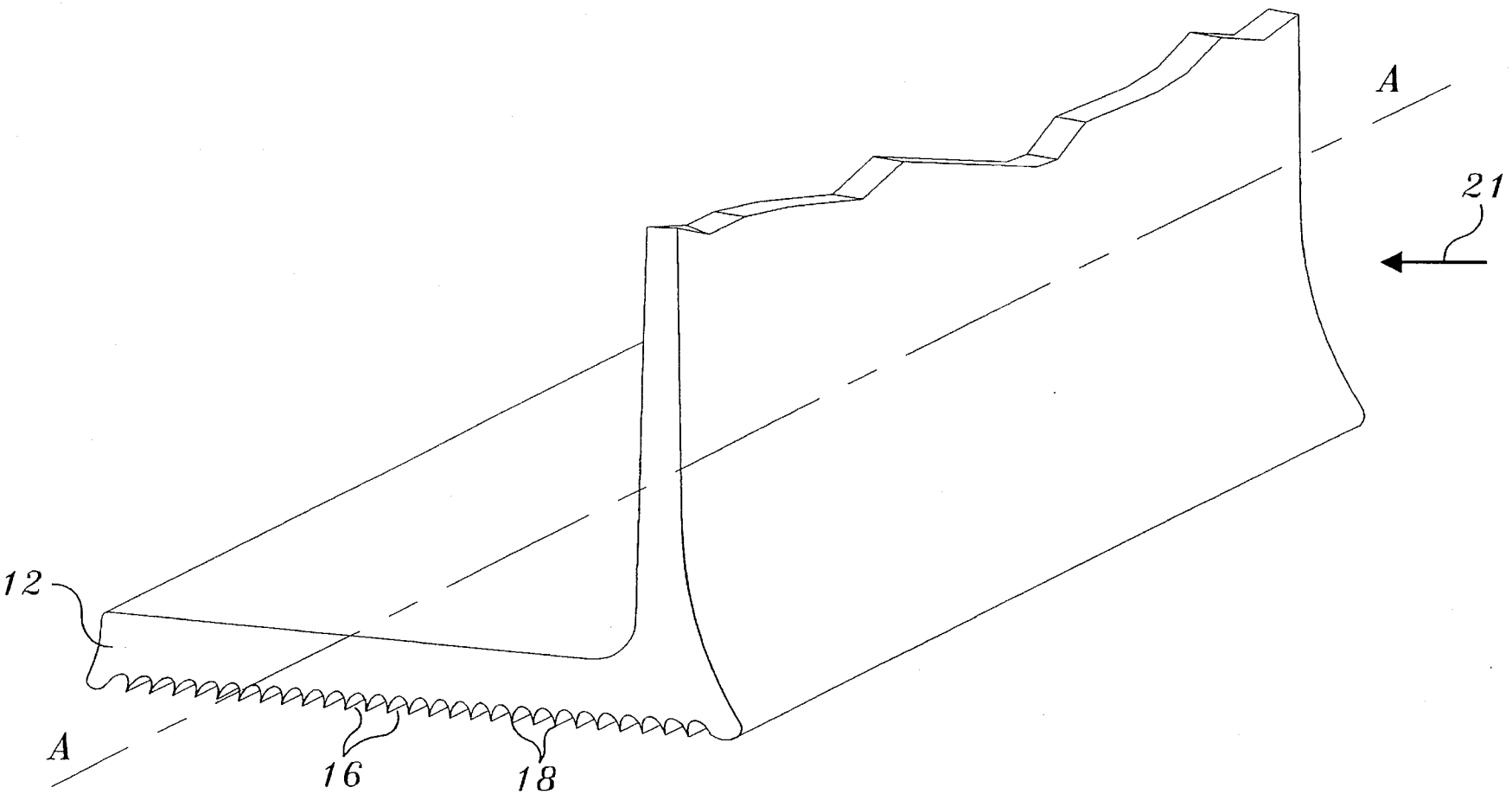
FIG. 4 is a partial enlarged view of the base suitable for inclusion in any of the embodiments of the present invention.
Figure 5:
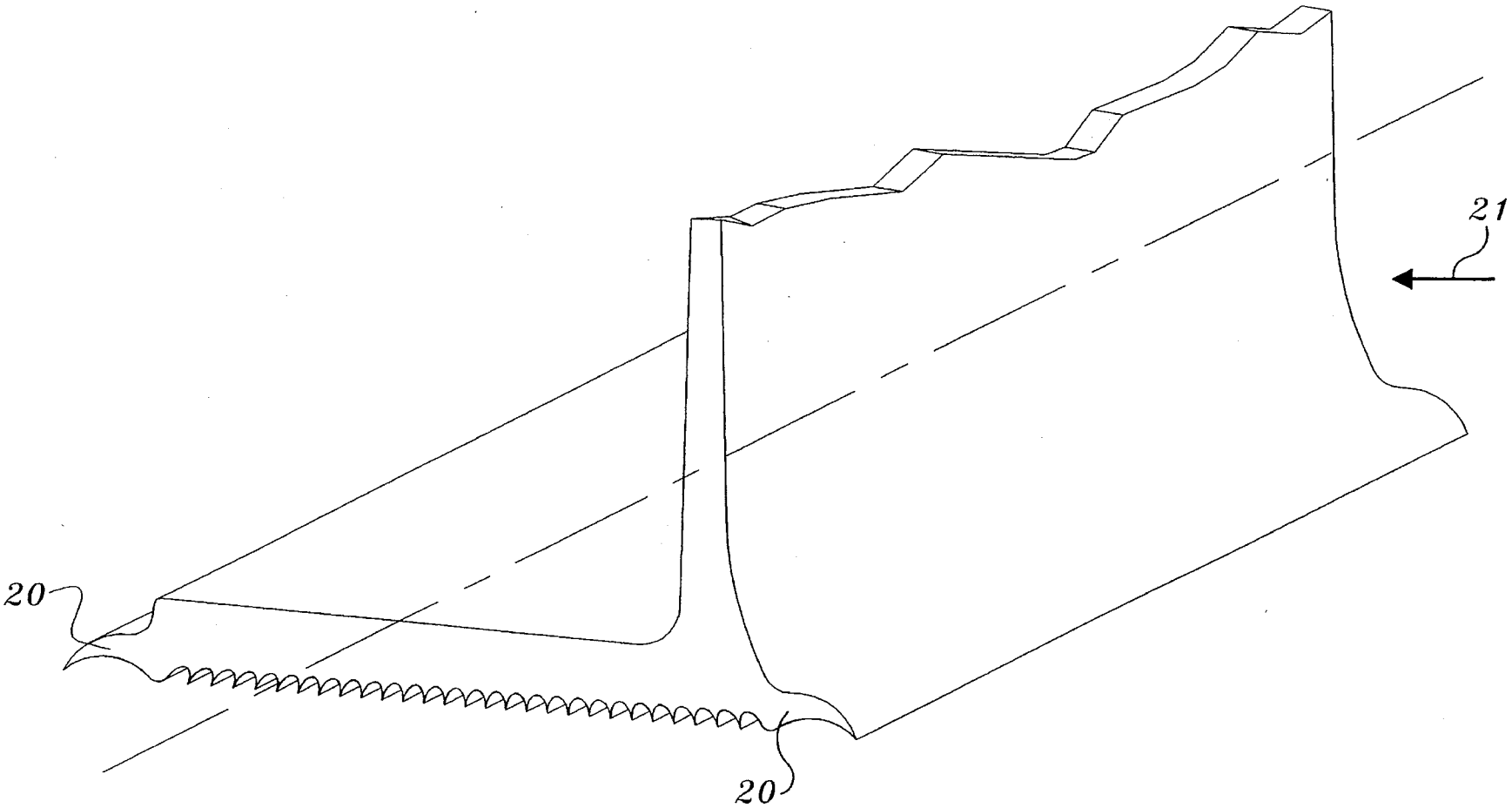
FIG. 5 is a partial enlarged perspective view of a second embodiment of a base suitable for inclusion in any of the embodiments of the present invention.

Now referring to FIGS. 4 and 5, alternate configurations for the base of the roadway marker are shown. In the embodiment shown in FIG. 4, the base includes a series of parallel grooves 16. The grooves are disposed adjacent and parallel to one another and to a longitudinal centerline A—A of the base 12. The grooves 16 extend the entire length of the base 12. The paralleled grooves 16 are formed such that they define a series of sharp pointed teeth 18. While the grooves could be used to form teeth with an arcuate cross section pointing straight down, preferably, the cross section of the teeth 18 are configured such that they curve and point away from the centerline in order to more firmly attach the roadway marker to the roadway surface. As a vehicle contacts the roadway marker, the action of the contact tends to pull the roadway marker away from the roadway. As the roadway marker moves, the adhesive between the base and roadway tends to elongate and thus risks becoming detached from the lower surface of the base. The configuration of the grooves 16 and teeth 18 lock the adhesive into the base. Furthermore, by configuring the cross section of the teeth 18 to establish teeth pointing away from the centerline, some of the teeth tend to dig into and grip the adhesive no matter whether the force applied to the roadway marker comes from the right or left as shown in FIG. 4.

In addition to the use of grooved teeth 18 the base of the roadway marker could also include two outwardly and downwardly extending curved edges 20, one located along the leading edge and the other located along the trailing edge of the roadway marker as shown in FIG. 5. Both edges 20 curve outwardly and downwardly from the base along its length. The outward and downward curvature of the edges 20 allows for enhanced gripping of the roadway surface. As a vehicle's tire impacts the roadway marker in the direction shown by the arrow 21, the contact tends to force the edges 20 to dig into the roadway surface, thus further helping to prevent the roadway marker from detaching from the roadway surface.

While the preferred embodiment of the invention has been illustrated and described, it will be appreciated that various changes can be made therein without departing from the spirit and scope of the invention. As an example, the geometry of the roadway marker, including the location of the reflective strips, the shape of the grooves in the lower surface, and the shape of the nubbles, could be modified without departing from the scope of the invention. Similarly, the roadway marker could be formed having more than two sections with different material properties.

The embodiments of the invention in which an exclusive property or privilege is claimed are defined as follows:

1. An extruded roadway marker, comprising:

a roadway marker formed of a dual durometer extrusion formed of at least two materials having different flexural moduli, the dual durometer extrusion including:

a base for attachment to a roadway surface;

a leg extending upwardly from the base; and a flexible transition region interposed between the base and leg.

2. The roadway marker of claim 1, wherein the base and transition region are formed of a material having a lower flexural modulus than the material from which the leg is formed.

3. The roadway marker of claim 1 or 2, wherein the transition region includes a reverse curve that begins near one edge of the base and extends rearwardly approximately parallel to an upper surface of the base and then arches upwardly to the leg, the transition region being adapted to deform downwardly in a direction of curvature of the reverse curve, when oncoming traffic comes into contact with the roadway marker.

4. The roadway marker of claim 1, further comprising a reflective portion located on the leg, the reflective portion being formed of a material having a flexural modulus approximately the same as the flexural modulus of the material from which the leg is formed.

5. The roadway marker of claim 1 or 2, wherein a lower surface of the base facing the roadway surface includes a plurality of parallel adjacent grooves that join one another so as to define sharp teeth lying parallel to a centerline of the base and extending along the length of the base.

6. The roadway marker of claim 5, wherein said sharp teeth project away from the centerline of the base.

7. The roadway marker of claim 5, wherein the base further includes two gripping edges lying parallel to said centerline and curving downwardly from the base.

8. The roadway marker of claim 5, wherein the transition region includes a reverse curve that begins along one edge of the base and extends rearwardly approximately parallel to an upper surface of the base and then arches upwardly to the leg.

9. The roadway marker of claim 8, further comprising a reflective portion located on the leg, the reflective portion being formed of a material having a flexural modulus approximately the same as the flexural modulus of the material from which the leg is formed.

10. An extruded roadway marker comprising:

a base for attachment to a roadway surface;

a leg extending upwardly from the base;

a flexible transition region interposed between the base and leg; and a separate and discrete nubble extending outwardly from a surface of the transition region and positioned so that when the leg is deformed downwardly toward the roadway surface, the nubble contacts and causes the leg to bend around the nubble to increase the radius of curvature of the flexible transition region when the leg is in a bent configuration.

11. The roadway marker of claim 10, wherein the nubble extends outwardly from the transition region along the length of the roadway marker.

12. The roadway marker of claim 11, further comprising a groove in the lower surface of the base beneath the transition region, the transition region having an approximately constant cross-sectional area in the portion of the transition region adjacent the groove.

13. The roadway marker of claim 10, further comprising a groove in the lower surface of the base beneath the transition region, the transition region having an approximately constant cross-sectional area in the portion of the transition region adjacent the groove.

14. The roadway marker as claimed in claims 10, 11, 12, or 13, wherein the roadway marker is a dual durometer extrusion formed of at least two materials having different flexural moduli.

15. The roadway marker of claim 14, wherein the base and the transition region are formed of a material having a lower flexural modulus than the material from which the leg is formed.

16. The roadway marker of claim 15, further comprising a reflective portion located on the leg and wherein the flexural modulus of the material forming the leg is approximately the same as the flexural modulus of the material from which the reflective portion is formed.

17. The roadway marker of claim 14, further comprising a reflective portion located on the leg and wherein the flexural modulus of the material forming the leg is approximately the same as the flexural modulus of the material from which the reflective portion is formed.

18. The roadway marker of claims 10, 11, 12, or 13, wherein a lower surface of the base facing the roadway surface includes a plurality of parallel adjacent grooves that join one another so as to define sharp teeth lying parallel to a centerline of the base and extending along the length of the base.

19. The roadway marker of claim 18, wherein said sharp teeth project away from the centerline of the base.

20. The roadway marker of claim 19, wherein the base further includes two gripping edges lying parallel to said centerline and curving downwardly from the base.

21. The roadway marker of claim 18, wherein the base further includes two gripping edges lying parallel to said centerline and curving downwardly from the base.

22. An extruded roadway marker, comprising:

a base for attachment to a roadway surface;

a leg extending upwardly from the base; and a transition region including a reverse curve that begins at one edge of the base and extends immediately rearwardly approximately parallel to an upper surface of the base then arches upwardly to the leg, the leg being adapted to bend downwardly toward the base along the direction of a radius curvature of the reverse curve to increase the radius of curvation when the roadway marker is contacted by oncoming traffic.

23. The roadway marker of claim 22, wherein a lower surface of the base facing the roadway surface includes a plurality of parallel adjacent grooves that join one another so as to define sharp teeth lying parallel to a centerline of the base and extending along the length of the base.

24. The roadway marker of claim 23, wherein said sharp teeth project away from the centerline of the base.

25. An extruded roadway marker, comprising:

a roadway marker formed of a unitary extrusion of two different materials having different flexural moduli, the extrusion including:

a base for attachment to a roadway surface;

a leg extending upwardly from the base; and a flexible transition region interposed between the base and leg.

26. The roadway marker of claim 25, wherein the base and transition region are formed of a material having a lower flexural modulus than the material from which the leg is formed.

27. The roadway marker of claim 25, further comprising a separate nubble extending outwardly from a surface of the transition region and adapted to increase the radius of curvature of the transition region when the leg is deformed downwardly toward the roadway surface.

28. The roadway marker of claim 25, wherein the transition region includes a reverse curve that begins near one edge of the base and extends rearwardly approximately parallel to an upper surface of the base and then arches upwardly to the leg, wherein the leg is adapted to deform downwardly toward the base along the direction of curvature of the reverse curve when the leg is contacted by oncoming traffic.

29. An extruded roadway marker, comprising:

a dual durometer extrusion formed of at least two materials having different flexural moduli, the dual durometer extrusion including:

a base for attachment to a roadway surface;

a leg extending upwardly from the base; and a flexible transition region interposed between the base and the leg, wherein the base and transition region are formed of a material having a lower flexural modulus than the material from which the leg is formed.

30. An extruded roadway marker, comprising:

a dual durometer extrusion formed of at least two materials having different flexural moduli, the dual durometer extrusion including:

a base for attachment to a roadway surface;

a leg extending upwardly from the base; and a flexible transition region interposed between the base and leg, the transition region including a reverse curve that begins near one edge of the base and extends rearward approximately parallel to an upper surface of the base and then arches upwardly to the leg, the transition region being adapted to deform downward in a direction of curvature of the reverse curve, when oncoming traffic comes into contact with the roadway marker.

31. An extruded roadway marker comprising:

a dual durometer extrusion formed of least two materials having different flexural moduli, the dual durometer extension including;

a base for attachment to a roadway surface;

a leg extending upwardly from the base;

a flexible transition region interposed between the base and leg; and a separate and discreet nubble extending outwardly from a surface of the transition region and adapted for increasing the radius of curvature of the flexible transition region when the leg is deformed downwardly toward the roadway surface.

32. An extruded roadway marker comprising:

a unitary extrusion of two different materials having different flexural moduli, the extrusion including:

a base for attachment to a roadway surface;

a leg extending upwardly from the base;

a flexible transition region interposed between the base and leg; and a separate nubble extending outwardly from a surface of the transition region and adapted to increase the radius of curvature of the transition region when the leg is deformed downward toward the roadway surface.

* * * * *